United States Patent [19]

Powers et al.

[11] 3,991,777

[45] Nov. 16, 1976

[54] COSMETIC APPLICATOR

[76] Inventors: Ronald J. Powers, 109 S. Poinsettia St., Manhattan Beach, Calif. 90266; John M. Van Zandt, 701 E. Medio Drive, Pacific Palisades, Calif. 90272

[22] Filed: Dec. 8, 1975

[21] Appl. No.: 638,900

[52] U.S. Cl. ..... 132/88.7

[51] Int. Cl.[2] ..... A45D 40/26

[58] Field of Search ..... 132/88.7, 88.5, 83

[56] References Cited

UNITED STATES PATENTS

| | | | |
|---|---|---|---|
| 3,062,222 | 11/1962 | Quinn | 132/88.7 |
| 3,850,183 | 11/1974 | Gruska | 132/88.7 |
| 3,913,595 | 10/1975 | Grisel | 132/88.7 |
| 3,934,598 | 1/1976 | Hayes | 132/88.7 |

*Primary Examiner*—G.E. McNeill

*Attorney, Agent, or Firm*—Subkow & Kriegel

[57] ABSTRACT

A cosmetic applicator, such as a lipstick applicator, includes an inner cosmetic holder or cup in which a cosmetic mass or lipstick is securable and which is disposed within an outer cylindrical tubular member, the holder or cup being shiftable in forward and rearward directions to propel the cosmetic mass or lipstick out of the tubular member or to retract it therewithin. A transparent enclosing cap can be moved over the tubular member when the holder and cosmetic mass or lipstick are in retracted position to protect the internal mass or lipstick. The base of the cap carries an opaque dummy lipstick top simulating the shape of the lipstick or other cosmetic mass disposed in the holder or cup, the dummy top having a shade matching that of the lipstick. The dummy lipstick top can be seen through the transparent cap to indicate the shade of the lipstick without removing the cap. The dummy top covers the outer end portion of the lipstick and guards or shields it against the harmful effects of ultraviolet light.

14 Claims, 3 Drawing Figures

COSMETIC APPLICATOR

The present invention relates to cosmetic applicators, and more particularly to applicators for applying lipstick to a person's lips, or some other cosmetic mass to portions of a person.

It is desirable to observe the shade of a lipstick within a tubular member in which the lipstick is retained when the lipstick is in a retracted position, without having to unpack and open the container in which the cosmetic applicator might be disposed, which is often sealed and inaccessible to the purchaser. Heretofore, the purchaser was required to rely on a printed spot that matched the desired lipstick shade on a blister card, or the like, to determine the shade of the lipstick. When the lipstick is covered by a transparent cap when not in use, the lipstick shade can be seen through the cap. However, ultraviolet light changes the shades of most lipsticks, making it unsafe to have them exposed inside a transparent cap.

By virtue of the present invention, a transparent cap is employed for enclosing the lipstick and at least a portion of the mechanism used for propelling the lipstick in a forward direction from its surrounding tubular member or to retract the lipstick within the tubular member. The shade of the lipstick is determinable by attaching a dummy lipstick top to the forward end of a cap, the top simulating the shape of the lipstick and matching its shade as well. The dummy top is preferably of opaque material and its shape is such as to form a barrier to the passage of ultraviolet light, and the like, to the lipstick, thereby preventing deleterious affects caused by ultraviolet light impinging on the lipstick, which, as indicated above, can change the shade of the lipstick. Thus, the user can observe the shade of the lipstick as a result of viewing the dummy top, without the necessity for any manipulation of the lipstick applicator.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general priniciples of the invention; but it is to be understood that such detailed description is not to be taken in a limiting sense.

Referring to the drawings.

Figure 3:
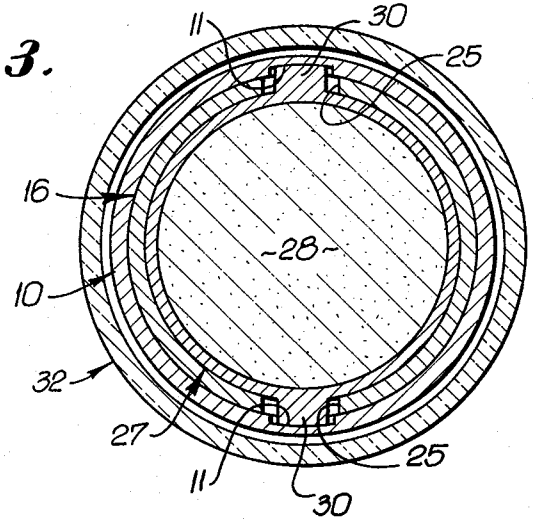
FIG. 3 is a cross-section taken on the line 3—3 of FIG. 2.
Figure 1:
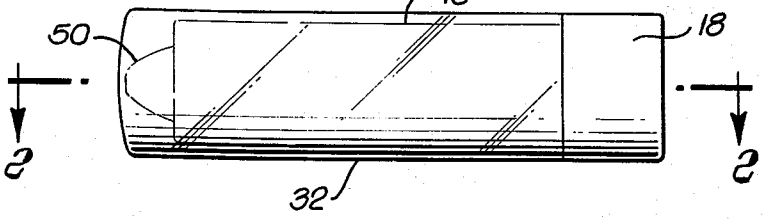
FIG. 1 is a side elevation of a cosmetic applicator embodying the invention and including a transparent cap.
Figure 2:
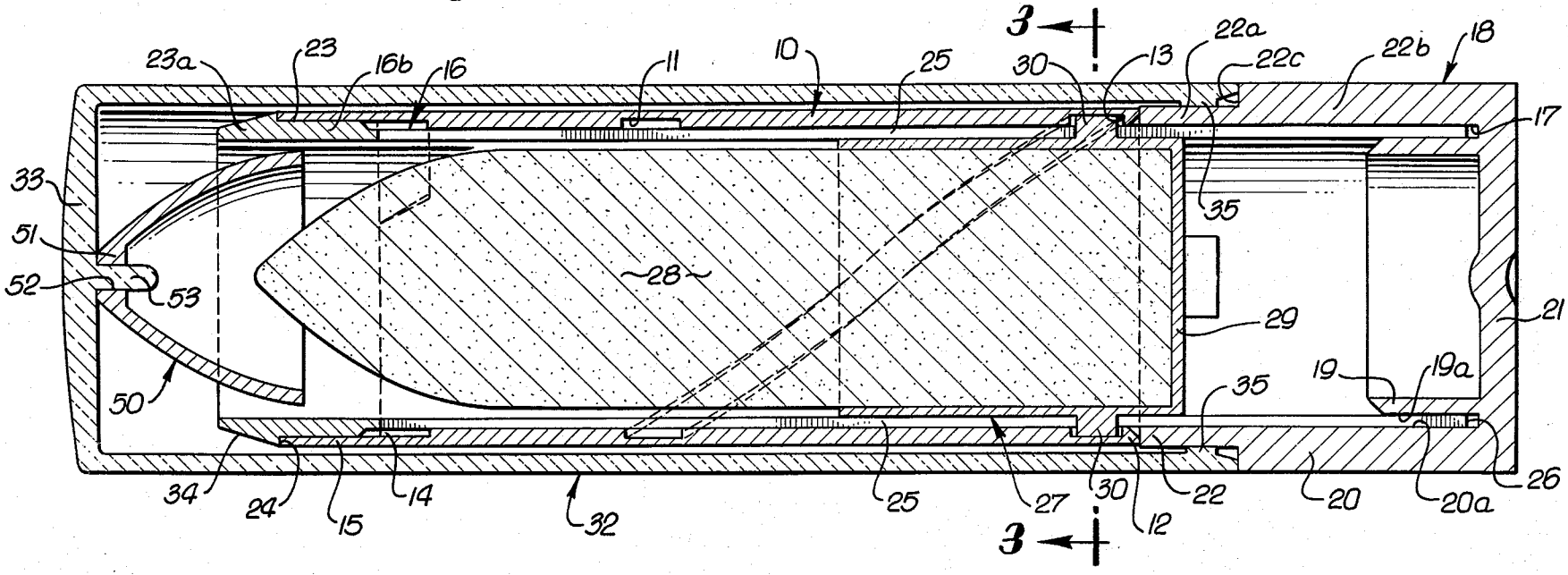
FIG. 2 is a longitudinal section on an enlarged scale taken along the line 2—2 of FIG. 1.

The cosmetic applicator includes an outer cylindrical tubular member 10 having an internal helical groove or thread 11 therein, such as a two-start thread or groove, the rear end of each thread or groove terminating short of the rear end 12 of the tubular member to provide a transverse stop 13. The forward end 14 of the thread or groove terminates or runs out at the forward portion 15 of the tubular member which has an enlarged internal diameter substantially the same as the diameter of the base of the groove 11.

Disposed within the tubular member is a cylindrical carrier sleeve 16 having a rear portion 16a extending beyond the rear end 12 of the tubular member and fitting within an annular groove 17 in a base portion 18 of the sleeve structure, the groove being defined between radially spaced inner and outer skirts 19, 20 extending forwardly from the end wall 21 of the base. The carrier sleeve 16 is initially separate from the base. When inserted in the groove 17, it makes a press fit against the confronting cylindrical surfaces **19*a*, 20*a* of the inner and outer skirts. The carrier sleeve may be secured to the base by welding it thereto, as through use of ultrasonic means. It is to be noted that the forward end 22 of the outer skirt terminates closely adjacent to the rear end 12 of the tubular member, the outer skirt having a forward portion 22*a* of substantially the same outside diameter as the diameter of the tubular member 10. The rear portion 22*b* of the outer skirt 20 has a larger outside diameter than the forward portion 22*a* to provide a shoulder 22*c***.

The carrier sleeve 16 has a forward circumferentially continuous portion or extension **16*b* in advance of the end 14 of the helical thread or groove. The extension has a periphery 23 of the same diameter as the internal diameter of the forward portion 15 of the carrier sleeve and an enlarged end 23*a* to provide a shoulder 24 extending partially across the forward end 15 of the tubular member, thereby preventing substantial forward axial movement of the tubular member 10 with respect to the carrier sleeve 16. Rearward longitudinal movement of the tubular member 10 on the carrier sleeve is prevented by engagement of the tubular member 10 with the forward end 22 of the outer skirt. Thus, the tubular member 10 is confined for relative turning or rotation with respect to the carrier sleeve 16 and its base 18**.

As specifically disclosed, the carrier sleeve 16 has a pair of diametrically opposed longitudinal slots 25 opening at the rear end 26 of the sleeve and terminating at the extension **16*b*. Disposed within the sleeve is a cup, socket or holder 27 adapted to have the rear portion of the cosmetic mass, such as lipstick 28, mounted therewithin which bears against an inwardly directed cup base 29. Integral with the cup are a pair of diametrically opposed lugs or keys 30 extending through the slots 25 for reception within the two-start internal helical thread or groove 11 of the tubular member 10. It is to be noted that engagement of the keys with the opposed sides of the slots 25 prevents the cup or holer 27 from partaking of any significant turning relative to the carrier sleeve 16. Accordingly, relative turning between the tubular member 10, on the one hand, and of the carrier sleeve 16, sleeve base 18 and cup 27, on the other hand, will result in longitudinal feeding of the cup and the cosmetic mass 28 secured therein along the carrier sleeve 16 and tubular member 10, which serve to enclose the lipstick 28. Such relative turning in one direction will result in retraction or rearward movement of the cup within the carrier sleeve to the extent limited by engagement of the lugs or keys 30 with the stops 13 provided at the rear end of the helical groove 11. Relative rotation in the opposite direction will shift the cup 27 and lipstick 28 in a forward direction to project the lipstick beyond the forward end of the carrier sleeve extension 16*b*, the forward movement of the cup and lipstick being limited by engagement of the lugs or keys 30** with the rear end of the extension.

A cylindrical cap 32 having a forward end wall 33 is provided which is adapted to be slipped over the extension 16*b* and the entire tubular member 10 into abutting relation to the skirt shoulder 22*c*, for the purpose of enclosing the open end of the carrier sleeve extension and the tubular member 10, as well as to protect the forward end of the lipstick. The circumferentially continuous extension preferably has its enlarged end 23*a* provided with a taper 34 which serves to guide the rear, open end of the cylindrical cap over the extension 16*b* and place it in a position coaxial with the other members of the cosmetic applicator. The cap, which is made of an elastic material, is held frictionally on the periphery of the forward portion 22*a* of the base 18 by circumferentially spaced cap tabs 35 frictionally engaging the periphery of the portion 22*a*. The cap may be removed by exerting sufficient forward pull thereon, the tabs being released from the forward portion 22*a*, permitting the cap to be shifted forwardly off the tubular member 10 and the extension 16*b*.

The specific mechanism illustrated in the drawings for propelling the lipstick 28 in a forward direction and for retracting it within the carrier sleeve 16 and the tubular member 10 forms no part of the present invention. Other suitable mechanisms for accomplishing the forward propelling and retraction functions can be used.

As specifically disclosed, the cap 32 is made of a suitable transparent material, such as styrene, acrilonitrile, or a polycarbonate. However, in accordance with the present invention, the lipstick cannot be viewed through the transparent cap because of the provision of a dummy lipstick top 50 which is hollow and of generally conoidal shape, to conform substantially to the conoidal shape of the forward portion of the lipstick 28. The apex portion 51 of the top has a passage 52 therethrough to enable the top to be shifted axially over a cap pin 53 and into engagement with the cap base 33. The pin 53 and top 50 may make a frictional fit with one another to secure the top to the pin.

The top 50 may be made of the same material as the cap 32, but it need not be transparent. It can be made of an opaque material, such as polypropylene. When the cap 32 is mounted in place, disposed completely over the entire tubular member 10 and in frictional engagement with the base 18, as disclosed in the drawings, the dummy top 50 prevents any substantial light from passing to the lipstick 28. Assuming the top to be made of a transparent material, less ultraviolet light can pass to the lipstick than in the absence of the dummy top. However, by making the dummy top of opaque material, substantially all ultraviolet light is prevented from being transmitted to the lipstick.

Not only does the dummy top protect the lipstick, but its shade can be made the same as the lipstick shade. Accordingly, the user can look through the transparent cap 32 and observe the shade of the top and make an appropriate selection of the lipstick shade desired from the many different colors of lipstick on display.

We claim:

1. A cosmetic applicator comprising an enclosure adapted to contain a cosmetic mass, means in said enclosure for effecting forward and rearward movements of the cosmetic mass within the enclosure to extend the mass beyond the forward end of the enclosure and to retract the mass within the enclosure, a transparent cap disposable over the enclosure to protect the mass and removable from the enclosure when the cosmetic mass is to be used, and a dummy member within and secured to the cap to protect the cosmetic mass when the cap is disposed over the enclosure.

2. A cosmetic applicator as defined in claim 1; said dummy member being substantially opaque.

3. A cosmetic applicator as defined in claim 1; said dummy member being secured to the forward end portion of said cap coaxially of said cap.

4. A cosmetic applicator as defined in claim 1; said dummy member being secured to the forward end portion of said cap coaxially of said cap, said dummy member being shaped to substantially conform to the shape of the forward end portion of the cosmetic mass to be contained in said enclosure.

5. A cosmetic applicator as defined in claim 1; said dummy member being secured to the forward end portion of said cap coaxially of said cap, said dummy member being shaped to substantially conform to the shape of the forward end portion of the cosmetic mass to be contained in said enclosure, said dummy member being substantially opaque.

6. A cosmetic applicator as defined in claim 1; said dummy member being hollow and having a conoidal shape, and means securing the small forward end of said dummy member to the forward end of said cap and coaxially of said cap.

7. A cosmetic applicator as defined in claim 1; said dummy member being hollow and having a conoidal shape, and means securing the small forward end of said dummy member to the forward end of said cap and coaxially of said cap, said dummy member being substantially opaque.

8. A cosmetic applicator comprising an elongate outer tubular member having internal helical thread means, an elongate carrier sleeve structure within said member having a rear base portion extending rearwardly beyond said member and an extension portion extending forwardly beyond the forward end of said member, said sleeve structure having a longitudinal slot, a holder for a cosmetic mass slidable longitudinally within said sleeve structure and having key means extending through said slot into mesh with said helical thread means, whereby relative turning between said tubular member and sleeve structure shifts said holder forwardly and rearwardly in said sleeve structure, a transparent cap disposable over said extension portion to protect the mass and removable from the extension portion when the mass is to be used, and a dummy member within and secured to the cap to protect the cosmetic mass when the cap is disposed over said extension portion.

9. A cosmetic applicator as defined in claim 8; said dummy member being substantially opaque.

10. A cosmetic applicator as defined in claim 8; said dummy member being secured to the forward end portion of said cap coaxially of said cap.

11. A cosmetic applicator as defined in claim 8; said dummy member being secured to the forward end portion of said cap coaxially of said cap, said dummy member being shaped to substantially conform to the shape of the forward end portion of the cosmetic mass to be secured to said holder.

12. A cosmetic applicator as defined in claim 8; said dummy member being secured to the forward end portion of said cap coaxially of said cap, said dummy member being shaped to substantially conform to the shape of the forward end portion of the cosmetic mass to be secured to said holder, said dummy member being substantially opaque.

13. A cosmetic applicator as defined in claim 8; said dummy member being hollow and having a conoidal shape, and means securing the small forward end portion of said dummy member to the forward end of said cap and coaxially of said cap.

14. A cosmetic applicator as defined in claim 8; said dummy member being hollow and having a conoidal shape, and means securing the small forward end portion of said dummy member to the forward end of said cap and coaxially of said cap, said dummy member being substantially opaque.

* * * * *